US006920709B2

(12) United States Patent
LaMalfa

(10) Patent No.: US 6,920,709 B2
(45) Date of Patent: Jul. 26, 2005

(54) SPORTS MEMORABILIA ARTICLES HAVING COLLECTABLE ATTRACTIVENESS ATTRIBUTES

(76) Inventor: Kenneth M. LaMalfa, 49 Sherwood Rd., Londonderry, NH (US) 03053

( * ) Notice: Subject to any disclaimer, the term of this patent is extended or adjusted under 35 U.S.C. 154(b) by 0 days.

(21) Appl. No.: 10/430,567

(22) Filed: May 6, 2003

(65) Prior Publication Data

US 2004/0221493 A1 Nov. 11, 2004

(51) Int. Cl.[7] ..... G09F 1/00
(52) U.S. Cl. ..... 40/124.01; 283/75
(58) Field of Search ..... 40/124.01, 124.2, 40/124.4; 283/74, 75, 78, 67, 68

(56) References Cited

U.S. PATENT DOCUMENTS 5,238,345 A * 8/1993 D'Andrea ..... 283/67
5,419,062 A * 5/1995 Polinski et al. ..... 40/124.4
5,971,435 A * 10/1999 DiCesare et al. ..... 283/67
6,082,774 A * 7/2000 Schlauch ..... 283/67
6,532,345 B1 * 3/2003 Gluck ..... 396/427

* cited by examiner

*Primary Examiner*—Lars A. Olson
(74) *Attorney, Agent, or Firm*—Joseph E. Funk

(57) ABSTRACT

An article of sports memorabilia having collectable attractiveness attributes is disclosed wherein common and personalized attributes are displayed on an article such as a home plate, tee shirt, glass or picture. The common attributes indicate the name of a stadium or field, a team, and a team player striking or kicking a sport ball such as a baseball, football or soccer ball. The personalized attributes indicate the name and address of a person or entity for whom the article is personalized, and the number of feet between the stadium or field, or home plate or other location on the field, and the address of the person for whom the article is personalized. A logo "From Our Home To Yours" on the article indicates the personalized distance between the field or stadium and the personalized address.

9 Claims, 1 Drawing Sheet

SPORTS MEMORABILIA ARTICLES HAVING COLLECTABLE ATTRACTIVENESS ATTRIBUTES

FIELD OF THE INVENTION

This invention relates to the field of articles of sports memorabilia, and more particularly to articles that are personalized for the owner in manner that is incorporated integrally with the articles.

BACKGROUND OF THE INVENTION

Personalizing article of sports memorabilia in a way that clearly associates them with their owner is widely recognized by memorabilia dealers and collectors as a way to add collectible value to the articles and as a way to make the articles more desirable to own. By merely affixing a personal attribute to a sports memorabilia article of relatively insubstantial worth, the article may be transformed into a memorabilia article of greater worth. The worth of such sports memorabilia may be further increased by having the genuine autograph (an autograph personally created by a preferred personality and not a facsimile thereof) of a famous sports personality.

The prior art encompasses affixing other types of attributes to sports memorabilia articles. Among these attributes are holograms, offset-printed identification number indicia, and facsimile autographs. Such attributes placed on all the articles and are not regarded as personality-created attributes. As a result they do not contribute as much to collectible attractiveness and collectible value as articles having distinctive personality-created attributes.

Thus, there is a need in the prior art for articles of sports memorabilia that are personalized for their owners in manner that is incorporated integrally with the articles. Accordingly, such articles have more collectible attractiveness and collectible value.

SUMMARY OF THE INVENTION

The present invention overcomes the above-described need in the prior art and fulfills the above-described need in the prior art in a way not previously provided by those of ordinary skill in the art.

Articles of sports memorabilia are provided that are personalized with collectable attractiveness attributes distinctive to the owners of the articles in a manner that is incorporated integrally within the articles. The result is appealing articles in which owners may have pride, thereby increasing their desirability and monetary value. In addition, the new sports memorabilia articles allow the creation of a new type of collector-targeted articles of sports memorabilia.

On these new articles of sports memorabilia the name and address of the persons who purchase the articles is placed, along with the identity of the sports stadium or field associated with the article, and other personalized information unique to the owner. This other information is in the form of the distance from the stadium or field to the owner's address and is placed on the article. The name, address and distance are personal collectable attractiveness attributes added to the articles of sports memorabilia that give them their distinctiveness and desirability.

DESCRIPTION OF THE DRAWING

The invention will be better understood upon reading the followed detailed description in conjunction with the drawing in which.

DETAILED DESCRIPTION

Figure 1:
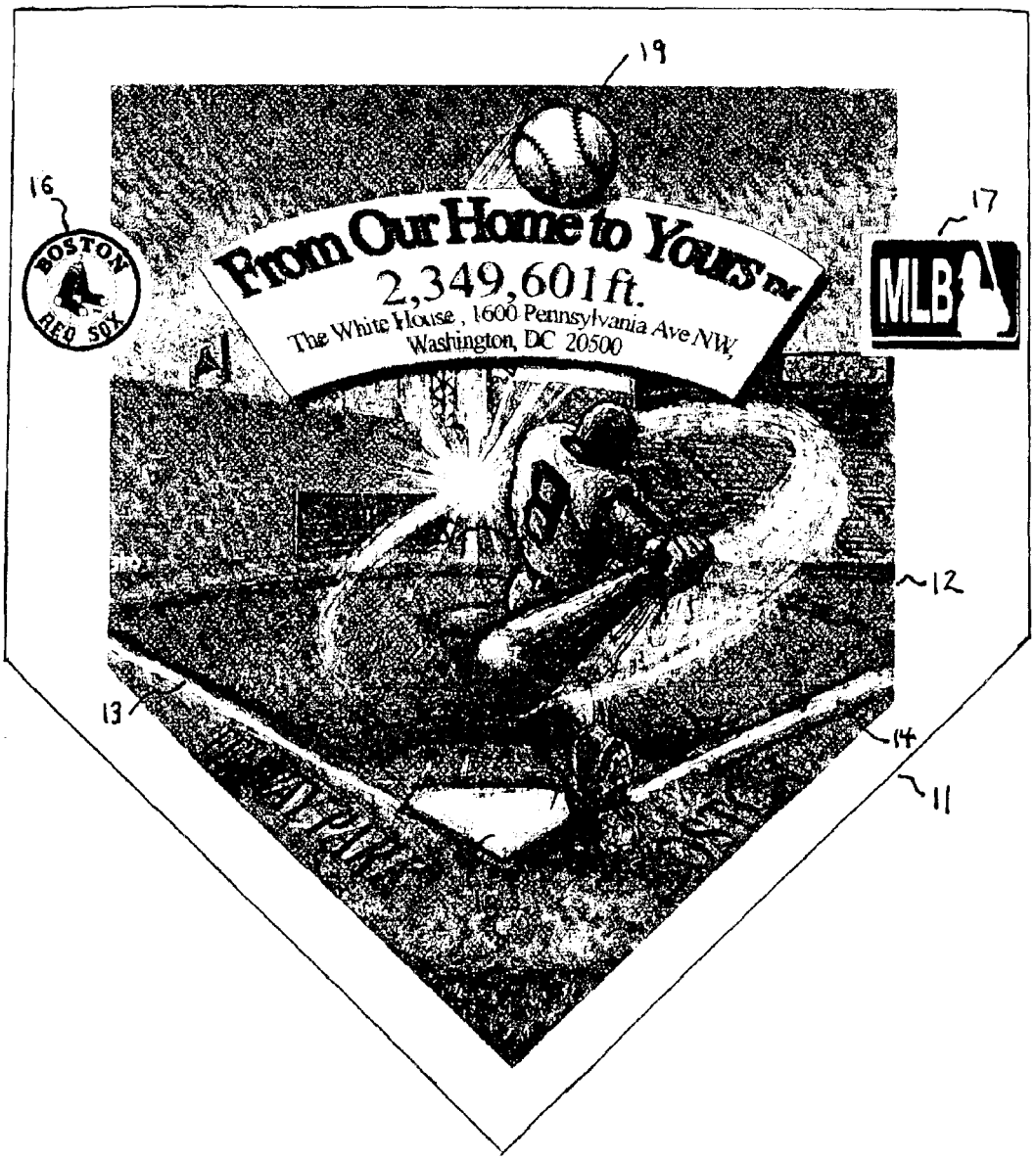
FIG. 1 is an example of an article of sports memorabilia in the form of a baseball home plate on which is a depiction of a ballpark including the identity of the ballpark and personalized information of the owner of the article.

Novel articles of personalized sports memorabilia in accordance with the teaching of the present invention may take a variety of forms. They include, but are not limited to, articles such as T-shirts, pictures, and miniature or full size baseball home plates. These articles in and of themselves are not novel, but their novelty arises from graphical information, some of which is personalized to the owner, that is placed on the articles of sports memorabilia. In the following description an article of personalized sports memorabilia in the form of a baseball home plate is described, but there may be different types of articles for each sport, and different graphics on articles for different sports in accordance with the teaching of the invention.

In the example of the invention described herein, common, pictorial information placed on an article of baseball memorabilia is in the form of an outline of a baseball home plate, graphics associated with the sport of baseball, plus personalized information unique to an owner of an article of baseball memorabilia. The home plate outline may be printed onto many types of articles including an actual home plate, a T-shirt or a drinking glass. The common information within the outline of the home plate includes a view of a baseball field and stadium from the home plate in the stadium, a ball player hitting a ball, and the name of the stadium. Other common information that may be included is the logo of the baseball team who calls the identified stadium their home field. In addition, personalized information is added and a logo that ties together all the common and personalized information.

In a preferred embodiment of the invention the personalized information is in the form of the name and address of the person who purchases the article of sports memorabilia, plus the approximate number of feet from the home plate of the identified stadium to the person's address.

With reference to FIG. 1, therein is shown an exemplary article of baseball memorabilia 11 in accordance with the teaching of the present invention. There is shown an outline of a home plate 12 printed on a miniature or actual home plate 11. The size of outline 12 will depend on the size of the article of sports memorabilia 11.

Within outline 12 is positioned the common information and the personalized information that gives article 11 its appeal and value. The common information is in the form of a depiction of a baseball field and stadium from the home plate in the stadium, a ball player hitting a long home run, and the name of the stadium printed along the first and third base baselines. In FIG. 1 the stadium is identified as Fenway Park in Boston, Mass. The words Fenway Park are shown along the third base line 13, and the word Boston is shown along the first base line 14. At the home plate is a batter 15, a member of the Boston Red Sox, whose home field is Fenway Park. The batter 15 has just hit a long, high hit indicating it is going out of the ball park. The number on the shirt of batter 15 can be that of a specific player on the Boston Red Sox team. In addition, although not shown in FIG. 1, the signature of the batter indicated by the number on the shirt of batter 15 can be printed or originally signed on article 11 when it is a larger article such as a home plate 11 or a tee shirt (not shown).

Also located on article 11 is a logo 16 of the team whose home field is identified along the first and third base lines. Since Fenway Park, Boston is identified in FIG. 1 the logo 16 shown is that of the Boston Red Sox. Or logos or Indicia such as 17 may also be added to article 11.

The last piece of common information on outline 12 is the logo "From Our Home To Yours". This logo is described further in this specification and it ties together the common information and personalized information on outline 12 on article 11 and is better understood after a description of the personalized information.

There is personalized information included in outline 12. The personalized information is in the form of the name and address of the person(s) purchasing the article of sports memorabilia 11, and the distance in feet between home base at Fenway Park and the purchaser's address. In FIG. 1 the example name and address are "The White House, 1600 Pennsylvania Avenue, Washington, D.C. 20500".

The global positioning system (GPS) is used to provide the next piece of personalized information in outline 12 on article 11. That is the number of feet between the home plate at Fenway Park and the personalized address. Presently GPS software is used in equipment that is used foe travel and provides distance information. GPS is used to get the coordinates of the home plate at Fenway Park. Software is available that can provide an approximate GPS coordinate to any given street address in at least built up areas of the United States. When the GPS coordinates of Fenway Park home plate and the personalized address (The White House in this example) are input to the GPS software program the distance, in feet, between the two is calculated. Although a number of feet is depicted on outline 12 in FIG. 1 it is not the real approximate distance in feet.

The logo "From Our Home To Yours" may now be better understood. It indicates the calculated distance between home plate at Fenway Park and the address depicted in outline 12 and, in a sort of double entendre, it indicates that the baseball 19 that has been hit by the player at home plate 18 has been hit so hard it is going to make it to the personalized address.

In an alternative embodiment of the invention, as applied to the sport of football, outline 12 may be rectangular and depict a football field with distant goal in a named stadium. The name of the stadium and location may be printed along yard lines of the field. The player in this example would be a football player kicking a football toward a far goal. There may be a number on the shirt of the player indicating the identity of the particular player. The personalized information is the name and address of the purchaser of the article of sports memorabilia. The logo will be that of the team whose home field is named along yard lines of the field depicted thereon. The logo "From Our Home To Yours" in this case indicates the distance between the field and the personalized address, and that the football has been kicked so hard it is going to travel to the personalized address.

In yet another alternative embodiment of the invention as applied to the sport of soccer, outline 12 may also be rectangular and depict a soccer field with distant goal in a named stadium. The player in this example would be a soccer player kicking a soccer ball toward a far goal. The name of the stadium and location is printed along lines of the field. The logo will be that of the team whose home field is named in outline 12. The personalized name and address is added. The logo "From Our Home To Yours" in this case indicates that the soccer ball has been kicked so hard are accurate that it will score a goal.

While what has been herein is one embodiment of the invention as applied to the sport of baseball, and two alternative embodiments to the sports of football and soccer, the teaching of the invention may be applied to other sports and other types of novel articles of sports memorabilia that are personalized with a collectable attractiveness attribute distinctive to the owner of the article.

What is claimed is:

1. An article of sports memorabilia having collectable attractiveness attributes and comprising:

an item to be the article of sports memorabilia;

common attributes on the item that indicate the sport and the home stadium or field of a sports team with which the article of sports memorabilia is associated; and personalized attributes on the item that are distinctive to each entity or person that obtains an article of sports memorabilia, the personalized attributes including the name and address of an entity or person for whom the item is personalized and a distance between the home stadium or field and the address of the entity or person for whom the article is personalized;

wherein, collectively, the common attributes and the personalized attributes combine with the item to create the article of sports memorabilia having collectable attractiveness attributes.

2. The invention in accordance with claim 1 wherein the common attributes on the article of sports memorabilia further comprises a logo indicating "From Our Home To Yours" indicating the distance between the stadium or field and the address of an entity, including a person, for whom the article is personalized.

3. The invention in accordance with claim 2 wherein the collectable attractiveness attributes of the article of sports memorabilia includes a shape associated with the sport for which the common and personalized attributes are displayed.

4. The invention in accordance with claim 3 wherein the collectable attractiveness attributes of the article of sports memorabilia includes a logo of a team that calls the sports field their home field.

5. The invention in accordance with claim 1 wherein the collectable attractiveness attributes of the article of sports memorabilia includes a shape associated with the sport for which the common and personalized attributes are displayed.

6. An article of sports memorabilia having collectable attractiveness attributes and comprising:

an item to be the article of sports memorabilia;

common attributes on the item that indicate a sports field with which the article of sports memorabilia is associated; and personalized attributes on the item that are distinctive to each entity or person that obtains an article of sports memorabilia;

wherein the sports field is the home stadium or field of a sports team, and wherein the personalized attributes on the article of sports memorabilia comprises a distance between the home stadium or field and an address of an entity, including a person, for whom the article is personalized; and wherein, collectively, the common attributes and the personalized attributes combine with the item to create the article of sports memorabilia having collectable attractiveness attributes.

7. The invention in accordance with claim 6 wherein the common attributes on the article of sports memorabilia further comprises a logo indicating "From Our Home To Yours" indicating the distance between the stadium or field and the address of an entity, including a person, for whom the article is personalized.

8. An article of sports memorabilia having collectable attractiveness attributes and comprising:

an item to be the article of sports memorabilia;

common attributes on the item that indicate a sports field with which the article of sports memorabilia is associated; and personalized attributes on the item that are distinctive to each entity that obtains an article of sports memorabilia;

wherein the collective attractiveness attributes of the article of sports memorabilia includes a logo of a team that calls the sports field their home field; and wherein, collectively, the common attributes and the personalized attributes combine with the item to create the article of sports memorabilia having collectable attractiveness attributes.

9. The invention in accordance with claim 8 wherein the collectable attractiveness attributes of the article of sports memorabilia includes a shape associated with the sport for which the common and personalized attributes are displayed.

* * * * *